United States Patent [19]

Paravella et al.

[11] Patent Number: 4,621,778

[45] Date of Patent: Nov. 11, 1986

[54] APPARATUS FOR AUTOMATICALLY DISCHARGING COPS FROM SPINNING MACHINES

[75] Inventors: Luciano Paravella, Pavia; Luigi Figini, Varedo, both of Italy

[73] Assignee: Snia Fibre S.p.A., Cesano Maderno, Italy

[21] Appl. No.: 687,429

[22] Filed: Dec. 28, 1984

[30] Foreign Application Priority Data

Dec. 30, 1983 [IT] Italy ..... 24456 A/83

[51] Int. Cl.[4] ..... B65H 67/04

[52] U.S. Cl. ..... 242/35.5 A

[58] Field of Search ..... 242/35.5 A, 35.5 R, 242/35.6 R

[56] References Cited

U.S. PATENT DOCUMENTS

| | | | |
|---|---|---|---|
| 3,791,126 | 2/1974 | Kose et al. | 242/35.5 A |
| 3,915,398 | 10/1975 | Corl | 242/35.5 A |
| 4,007,882 | 2/1977 | Isoard | 242/35.5 A X |
| 4,052,017 | 10/1977 | Schar | 242/35.5 A |
| 4,069,983 | 1/1978 | Muramatsu et al. | 242/35.5 A X |
| 4,079,898 | 3/1978 | Murakami et al. | 242/35.5 A |
| 4,340,187 | 7/1982 | Schippers et al. | 242/35.5 A |
| 4,427,158 | 1/1984 | Conrad | 242/35.5 A |
| 4,437,617 | 3/1984 | Cardell | 242/35.5 A X |
| 4,441,660 | 4/1984 | Cloud et al. | 242/35.5 A |

FOREIGN PATENT DOCUMENTS 0110275 6/1984 European Pat. Off. ..... 242/35.5 A

*Primary Examiner*—Stanley N. Gilreath

*Attorney, Agent, or Firm*—Wenderoth, Lind & Ponack

[57] ABSTRACT

The invention is concerned with a device for replacing cops with spools in a textile yarn spinning and winding system, comprising at least one main structure moving horizontally across at least one row of spool holding spindles for holding spools. The main structure includes an assembly for cutting and reattaching the yarns to the spools which is rigidly attached to said the main structure, and at least a spool changing assembly rotatable about and movable along a vertical axis. The thread cutting and reattaching assembly is movable vertically independently of the spool changing assembly, the spool changing assembly carrying at least two horizontal rigid elongated bodies in relation to their depth, anchored cantilever-fashion, the rigid bodies having a suitable cross-section to engage with the inside diameters of the spools. The thread cutting and reattaching assembly and the axes of the rigid bodies extend in a substantially vertical plane during the steps of cop loading on and spool discharging from the rigid bodies, whereby the steps and the operations of thread cutting and reattaching can take place with one positioning of the main structure in front of each of the spool holding spindles.

13 Claims, 12 Drawing Figures

APPARATUS FOR AUTOMATICALLY DISCHARGING COPS FROM SPINNING MACHINES

BACKGROUND OF THE INVENTION

There has long been in use for the production of textile yarns textile in the industry devices for removing cops from machinery whereon they are formed and replacing them with spools adapted to provide support for a freshly formed cop.

Such devices sometimes have significant disadvantages which makes their use generally inconvenient and restricts their widespread application, especially at existing plants where the available space between the machinery for extruding filaments and the various cop formation sites is often quite limited.

Conventionally operated devices, in fact, take considerable floor space for carrying out the operations in question, the devices often comprising several discrete pieced of machinery for carrying out the various operations involved, sometimes including a bin containing a supply of spools and/or a cop collecting bin.

Conventional devices for automatically removing cops are required in general to be positioned at several sites relative to a machine for replacement of spools in order to carry out the spool changing operation.

It is known, for instance, from European Patent No. 0026471, to employ a device for spool changing which can effect the operation automatically, but this device requires two carts for supporting the various operating assemblies, which carts require continued alternate positioning in front of a spindle whereon a cop is being formed, which is time consuming as well as involving a complex machine construction.

That patent discloses a method of delivering cops from the device in question to a collection cart, which requires considerable floor space.

In the production of continuous filament spinning from a melt, complexity of the plant upstream of the resulting thread winding machine requires that the thread extrusion should not be discontinued during the spool changing steps and suitable devices are employed to divert the thread and collect it throughout such operations. The thread being produced during this time period is regarded as scrap, which results in a waste of material.

In this situation, the rate at which the spool is changed and any other operations carried out with the thread winding disrupted is extremely critical, thus making desireable the availability of machines which do not require repeated positioning and which can provide for the spool change in a short time.

SUMMARY OF THE INVENTION

It is an object of this invention to provide a device in a single machine which is capable of carrying out said operations with a single positioning movement thus achieving simplification of the spool changing operation while performing it in decreased times.

A further object of the invention forming the subject matter of this application is to provide a device of limited floor size which has no parts devoted to storage of spools and/or cops.

These and other objects, which will be more apparent hereinafter, are achieved according to the invention by a device for feeding spools and withdrawing cops to and from a textile yarn spinning and winding system, comprising at least one main structure moving horizontally across at least one row of spool and cop holding spindles, the main structure carrying an assembly for cutting and reattaching the threads and at least a spool changing assembly which is rotatable about and movable along a vertical axis. The thread cutting and reattaching assembly is movable vertically independently of spool changing assembly. The spool changing assembly supports at least two horizontal rigid elongate bodies relative to their depth, anchored cantilever-fashion, the rigid bodies having a suitable cross-section to engage the inside diameters of said spools. The thread cutting and reattaching assembly may, for example, appreciably overlie said rigid bodies at least during the operations of:

loading cops onto said rigid bodies, discharging spools from said rigid bodies, thereby said operations and the thread cutting and cutting operation can be effected with a single positioning of said structure in front of each of said spool holding spindles.

The present invention is used with a textile machine which includes an assembly of devices which carry out the operations of extruding and spinning a chemical fiber through one or more dies for each assembly by means of several spinning assemblies, distribution of the fiber to spools, winding cops onto spools press fitted to rotating spindles, and other operations known in the art and required for yarn winding but unnecessary for understanding the operation of the cop discharging device in question.

In detail the operations required for changing the cop on a textile machine are:

(a) cutting and catching the thread(s) leaving the die(s);

(b) collecting by a suitable mechanism the thread(s) produced during the cop replacement operation;

(c) withdrawal of the cop(s) from the spool holding spindle whereon it has been formed;

(d) insertion of the empty spool(s) on a spool holding spindle and starting up to winding speed;

(e) attachment of the end of each thread to the respective spool;

(f) delivery of empty spools to suitable unloaded spool handling means for subsequent replacement.

BRIEF DESCRIPTION OF THE DRAWINGS

A better understanding of the operation of the discharge device forming the subject matter of the present invention may be had by making reference to the accompanying illustrations which show, by way of example and not of limitation, a preferential embodiment thereof, wherein:

FIG. 7*b* shows in dash lines the rotated arrangement taken by the thread suction and holding assembly;

DETAILED DESCRIPTION OF THE PREFERRED EMBODIMENTS

Figure 1:
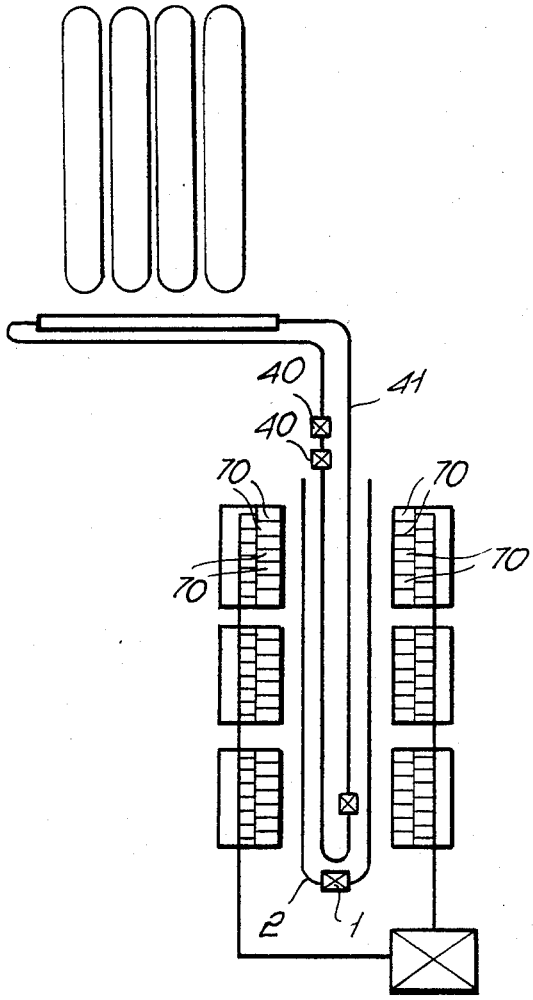
FIG. 1 illustrates a classical planimetric arrangement of the machine for producing synthetic fiber.
Figure 2:
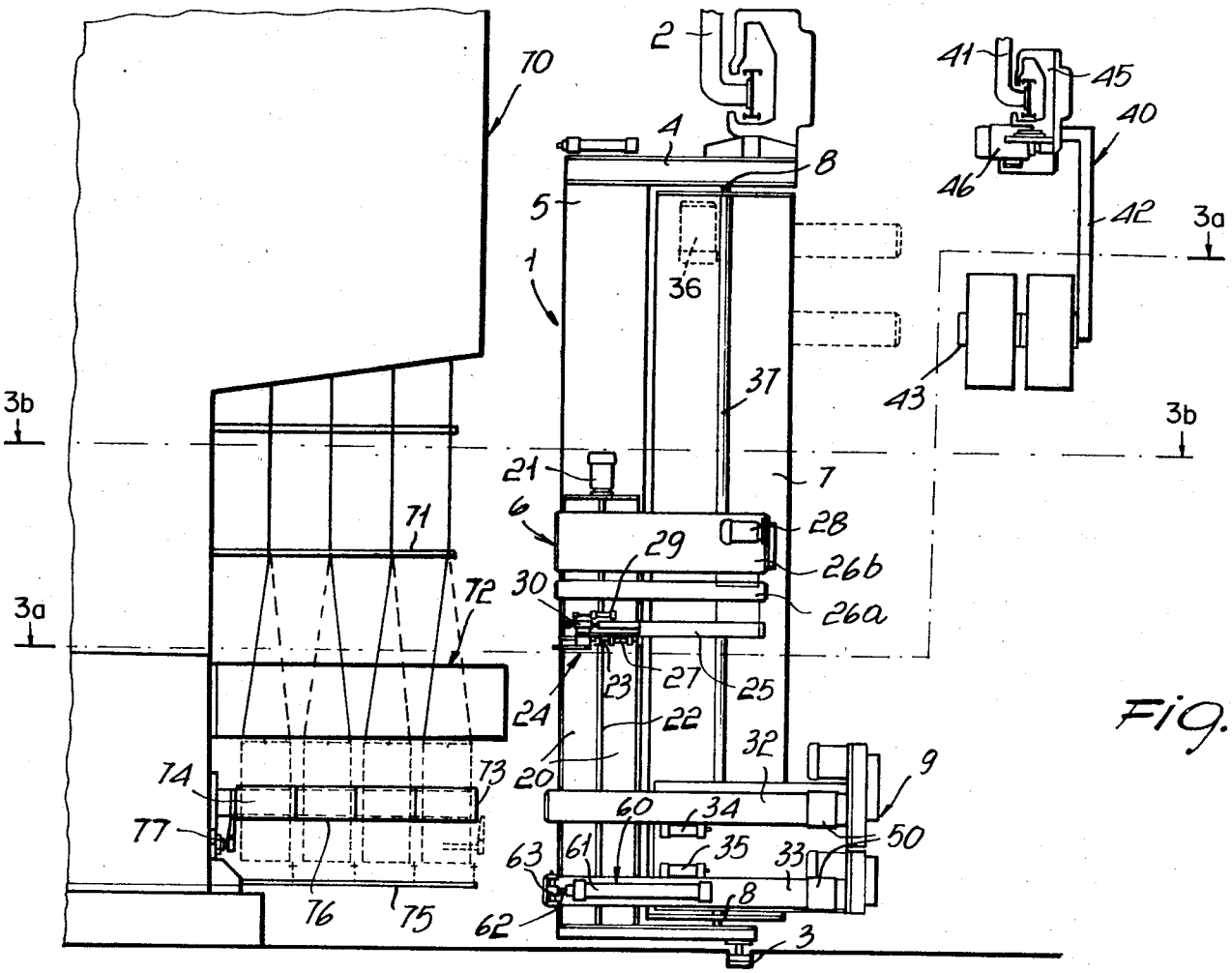
FIG. 2 shows a side view of the device in question, as obtained on a vertical plane perpendicularly to the direction of advance of the device itself.
Figure 3B:
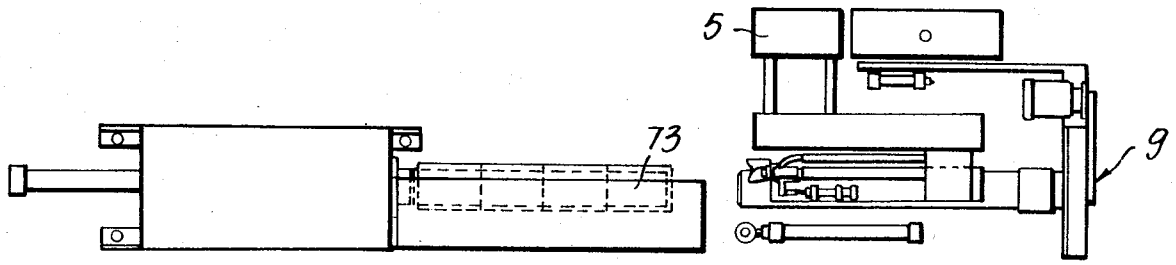
FIGS. 3*a* and 3*b* illustrate, respectively, two horizontal sections of the device of FIG. 2 taken along the lines 3*a*—3*a* and 3*b*—3*b* of FIG. 2.
Figure 3A:
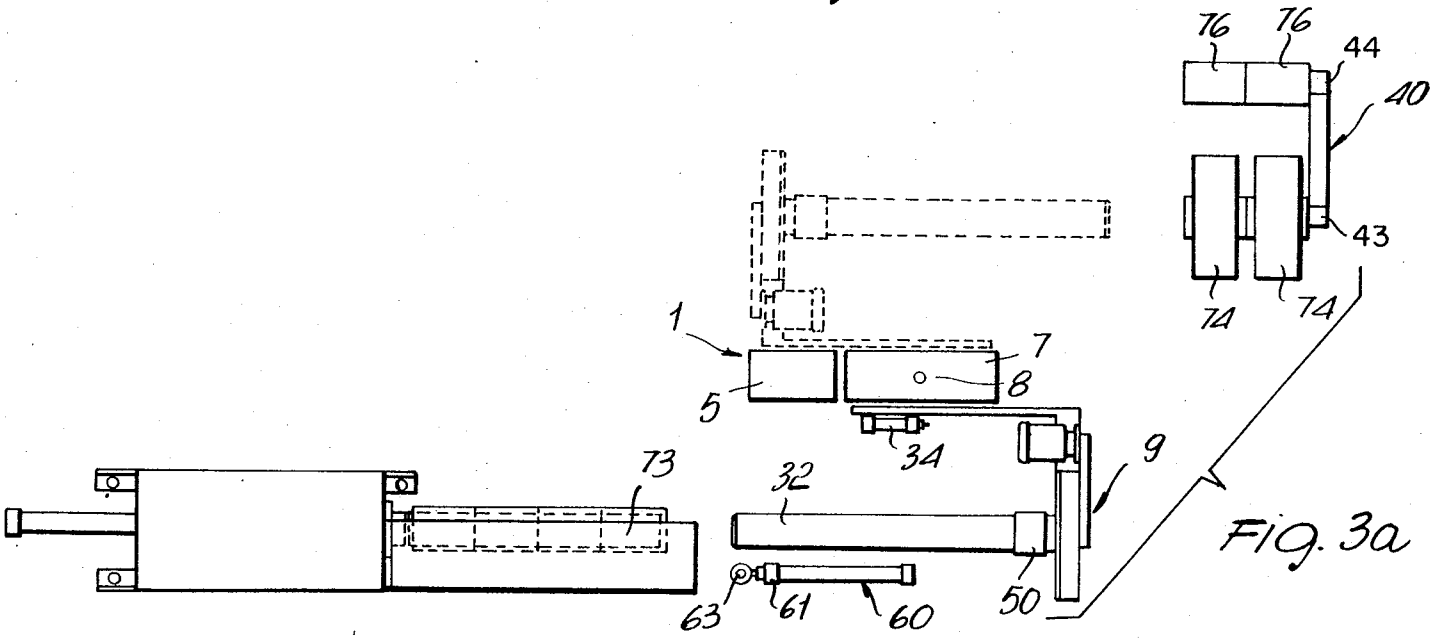
Figure 4:
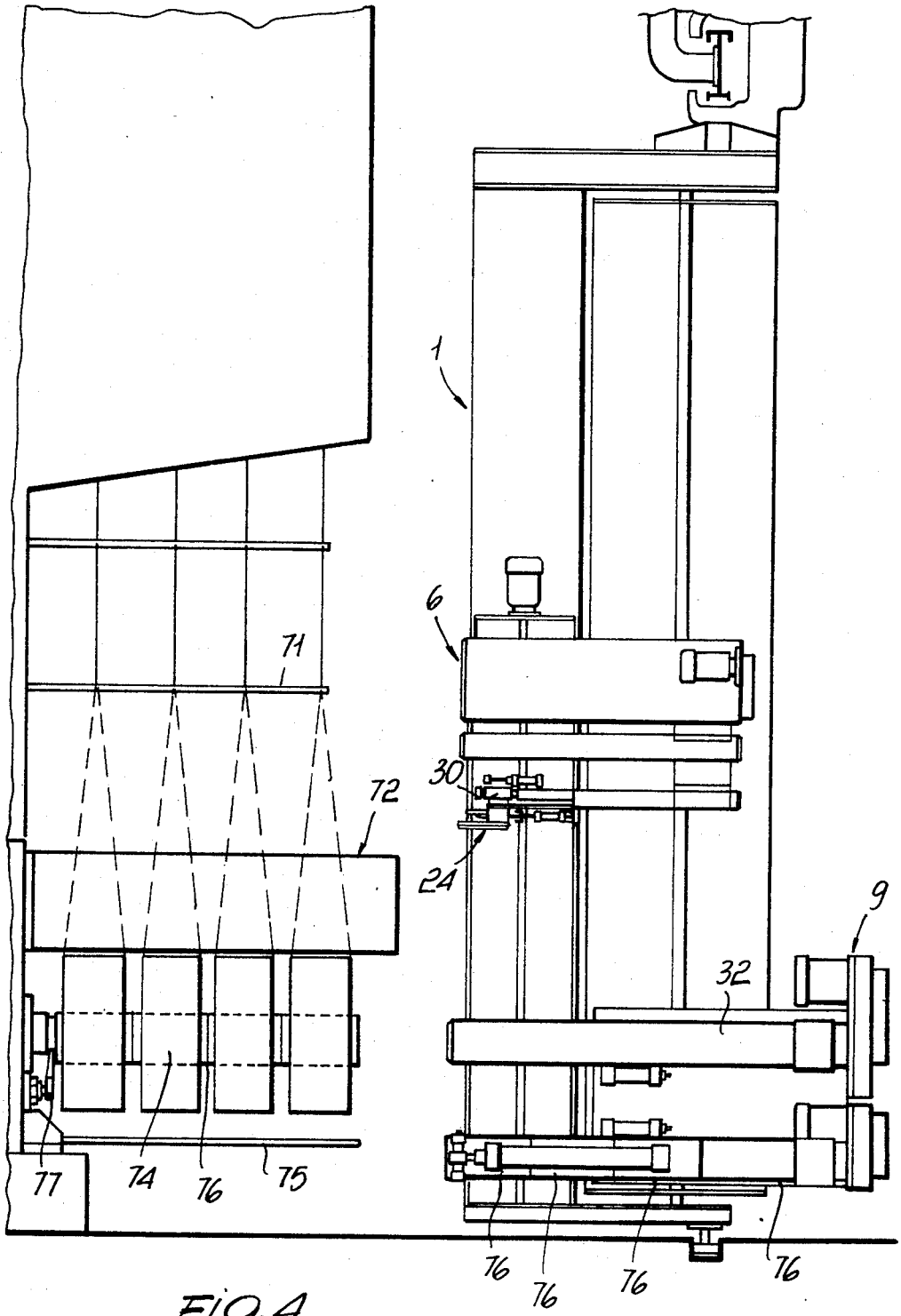
FIG. 4 illustrates a side view of the cops formed on the machine prior to starting the spool changing operation with the cutting assembly in the withdrawn position.
Figure 5A:
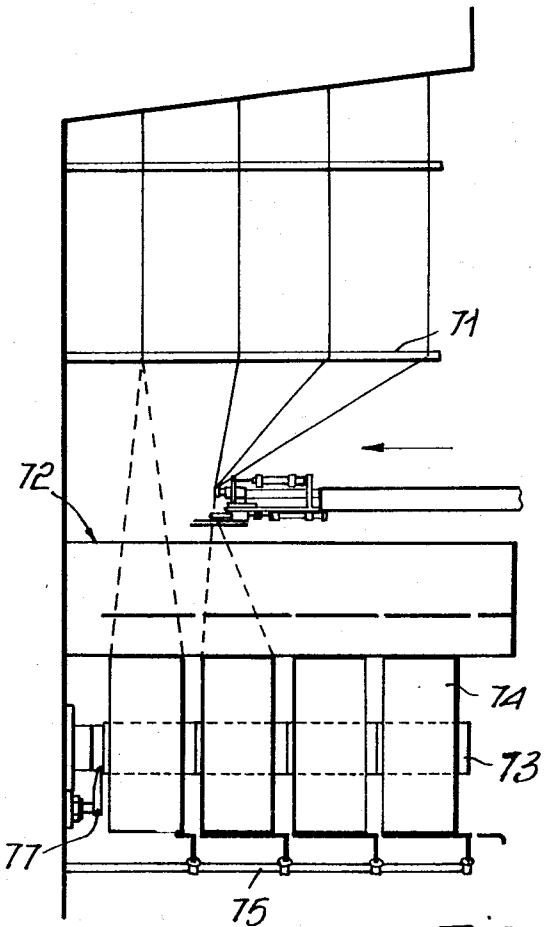
FIGS. 5*a* and 5*b* illustrate the thread cutting, respectively, in side and front views relative to the winding machine.
Figure 5B:
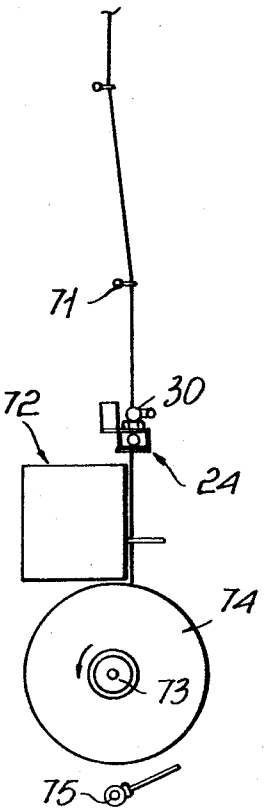
Figure 6:
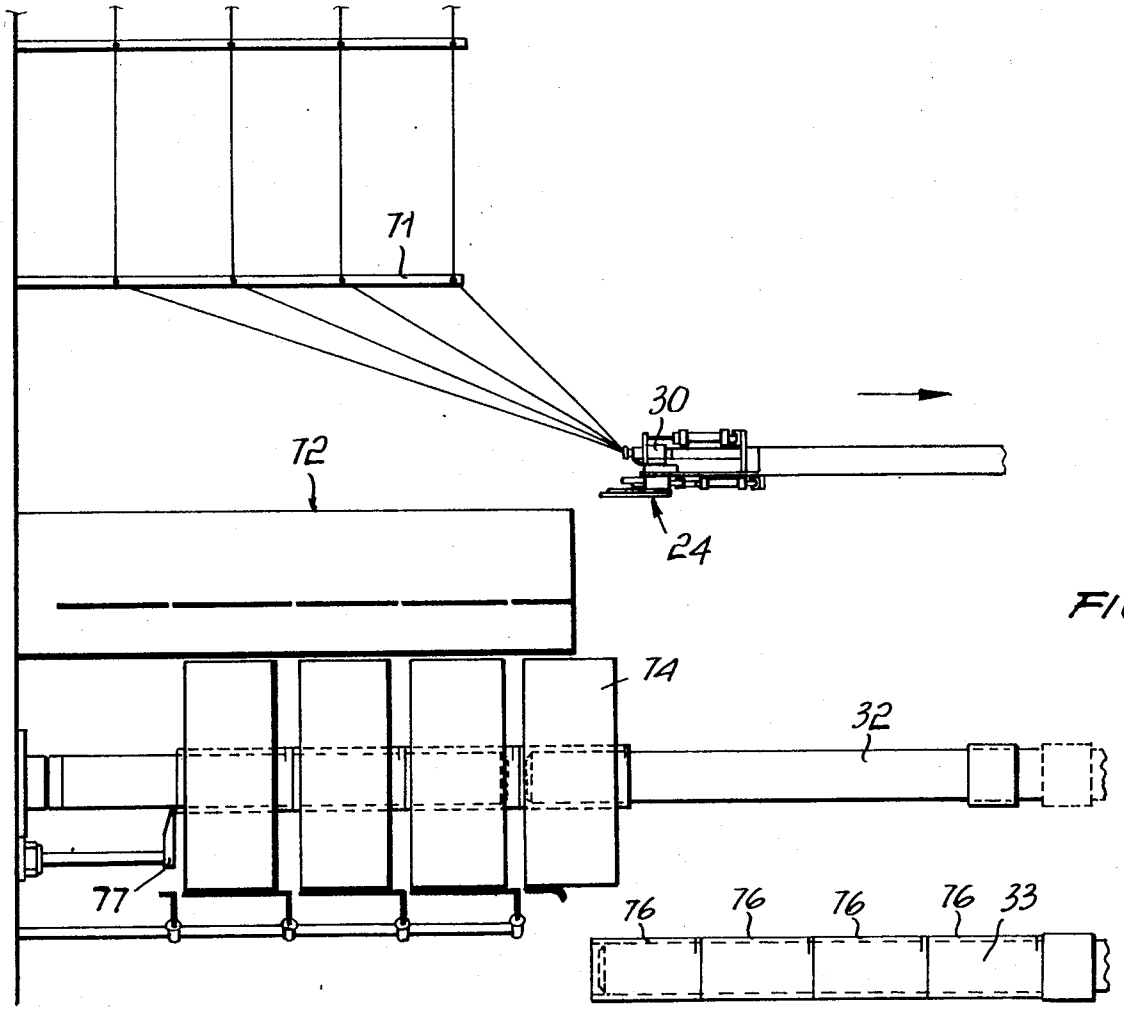
FIG. 6 illustrates a side view of the withdrawal of the cutting assembly and simultaneous ejection of the spools.
Figure 7A:
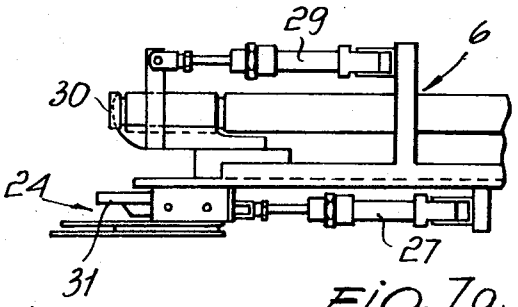
FIGS. 7*a* and 7*b* show, respectively, in front and plan views the apparatus for thread cutting and attaching the thread to the spool, in particular
Figure 7B:
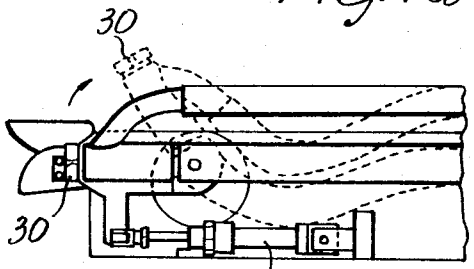
Figure 8A:
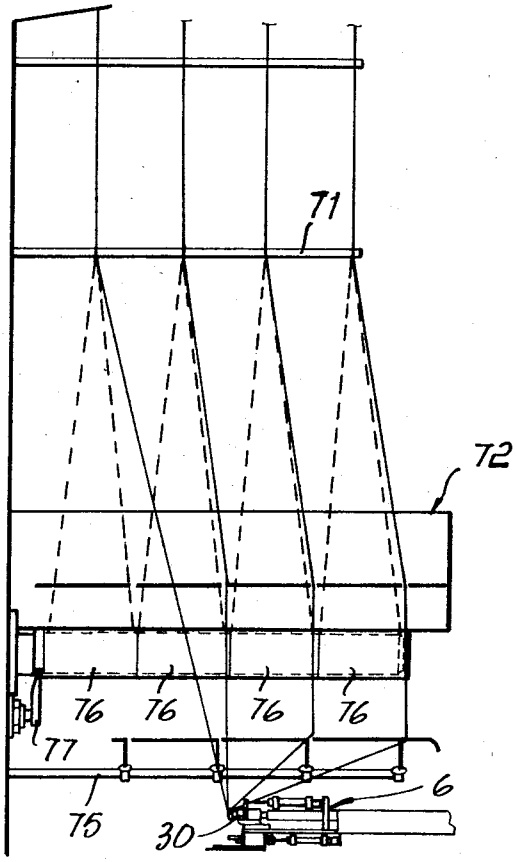
FIGS. 8*a* and 8*b* illustrate, respectively, in side and front views with respect to the winding machine, the step of distributing and attaching the threads, in particular, as regards the threads, the distribution step is illustrated in full lines and the attaching step is illustrated in broken lines.
Figure 8B:
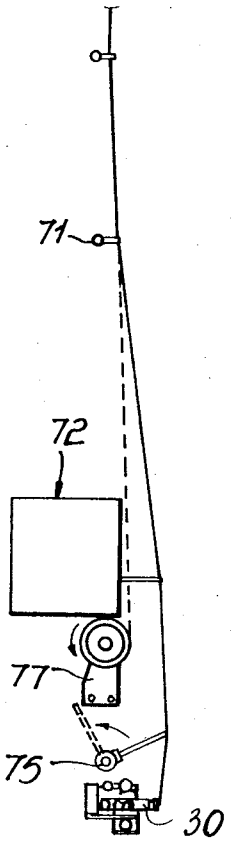

A textile machine 70 operating in concurrence with the discharge device forming the subject matter of the present invention is composed, inter alia, of a series of die assemblies, not shown, for example arranged in groups of four at a time along a straight line, each die comprising a plurality of holes, for the extrusion of the polymeric material filaments which are directed to form the textile fiber.

The multi-filament yarn thus formed is passed through a thread guide 71 arranged above a winding head 72, located above the cops 74 comprising a traversing device for each thread and a press roller intended to contact the surface of the cop being formed. The cops are wound on a spool holding or pressure spindle 73, which is in turn kept rotating by an electric motor not shown. A thread positioning device 75 is located in the area underlying the cops and ensures casting, i.e. attachment of the threads to the cops 74 or spools 76 which form the core of each cop.

An ejector 77, for example, driven by a pneumatic piston not shown, can push out of the spool holding spindle 73, the cops 74, which are slidably held on the spindle 73.

According to the invention, as exemplified herein, the main structure 1 moves along an overhead path 2, being engaged at its bottom portion, on a rail 3 laid on the floor, which ensures increased stability. The main structure 1 is composed of a structure comprising a supporting frame 4, slidably anchored to the overhead pathway 2 and rail 3, supporting two box-like columns. A first column 5 is arranged directly in front of the textile machine, whereon the spool changing operations are carried out, and is rigidly connected to the frame 4. The column 5 supports a thread cutting and reattaching assembly 6 and required devices which provide for vertical motion of the thread cutting and attaching assembly along column 5. A second column 7, pivotally attached to the frame 4 through the vertical axis pins 8, carries the spool changing assembly 9 and required devices for moving the spool changing assembly vertically along column 7.

Column 5 will now be considered in detail. Mounted on column 5 is a guide 20 whereon the thread cutting and reattaching assembly 6 moves. Raising and lowering of the thread cutting and reattaching assembly along the column is effected by an electric motor 21 through a worm 22 having a vertical axis and engaging with a thread 23 formed on the thread cutting and reattaching assembly 6. The thread cutting and reattaching assembly comprises a cutting device 24 mounted on a movable arm 25 having a substantially horizontal axis adapted to penetrate the textile machine and intercept and catch the threads in their path toward the spools. The motion of the horizontal cutting device 24 is effected by a double telescoping assembly 26*a* and 26*b* which is driven by an electric motor 28. The expansible assembly carries the cutting device 24 out of its home position to meet the threads from the extruder. The cutting device 24 includes a pair of blades 31 driven by a pneumatic cylinder 27.

A suction hose 30, rotating in a horizontal plane and operating on compressed air, is located directly above the cutting device. The cut off end of a thread by the cutting device is sucked up by the suction hose by virtue of its suction ability and then released from the suction hose toward a container (not shown), thus collecting the yarn produced during the entire spool changing operation.

The innovative feature of rotatability, or at any rate mobility, of the suction hose in a horizontal direction brings about an important advantage during the following step of reattachment of the thread ends to the spools. This horizontal movement avoids the need for repositioning of the entire main structure 1 in front of the spindle. Rotation of the suction hose is provided by the action of a pneumatic device 29.

The cut height is selected such that the cutting assembly will not interfere with the operation of the spool changing assembly and can at the same time effect the cut below the last thread guide before the traverser. As is known to those skilled in the art, the traverser of a textile machine is that device which allows for a correct distribution of the yarn on the cop being formed. There exists an optimum height from the last yarn finger to the traversing device which is required to prevent large oscillations of the thread due to the traverser motion and simultaneously ensure optimum tension on the thread at each area of the cop.

The thread cutting and reattaching assembly 6 can move vertically to perform the thread reattaching operations to each spool, being assisted by known devices for dividing and distributing the threads to the spools, as well as for attaching them to the spools.

Next, the spool changing assembly 9 will be discussed. The spool changing assembly 9 is mounted for vertical movement on the column 7, which is pivotally mounted on the frame 4. The spool changing assembly 9 essentially comprises two substantially cylindrical bodies 32 and 33 having their axes substantially horizontal, and being adapted to be driven in a horizontal direction, to abut, to form an extension thereof, against the spool holding spindle of the filament extruding machine. The approaching movement in the vertical direction of the spool changing assembly 9 to the spool holding spindle 73 takes place through a vertical movement of the whole spool changing assembly by an electric motor 36 and a worm connected thereto 37, engaging with a thread formed on the spool changing assembly 9.

The approaching movement of cylindrical bodies 32, 33 in the horizontal direction takes place by the operation of a respective pneumatic piston 34 and 35. The upper cylindrical body 32 is intended to carry the cops, whereas the lower body 33 provides for storing and delivering empty spools. Both can be moved, at different times, to face the spool holding spindle 73.

A remarkable feature of the instant invention is that it provides for cop discharge and spool loading without requiring the frame 4 to be moved out of its position taken at the start of the operation, due to empty spool loading and cop discharging taking place on the opposite side of the main structure with respect to the front of the spindles. In fact, rotation of the column 7 enables the spool changing assembly to perform loading and discharging operations which may be similar to or different from those effected on the spindle of the winding machine even in a rotated position, for example, through 180°, without interfering with the action of the thread cutting and reattaching assembly.

In the embodiment of the spool changing assembly set forth by way of example, the spool changing assembly will pick up empty spools from a carrier 40 moving on an overhead path 41 to optimize accessibility to the winding machines at floor level.

The carrier comprises a support 42 having two arms 43 and 44, and an appropriate means of securing it to an overhead runway 45, and a transport device 46; the carrier is moved to and from storage areas whereat the carrier pick up empty spools and delivers cops. It is noteworthy that the provision of a transport system based on the use of carriers avoids the necessity of bins for cops and/or spools, thus limiting the device space requirements with respect to what was known heretofore and ensuring a faster delivery of the packaged cop, practically continuously instead of in batches.

Several further details make the operation of the device of the invention particularly effective, although not indispensable these additional features form a preferential embodiment of of this invention.

A further drive source acting on a worm internally of each cylindrical body 32, 33 of the spool changing assembly and not shown, moves each sleeve 50, of a larger diameter than the inside diameter of the spools, or a like device, axially along each cylindrical body 32 and 33, operating as an ejector for the spools and cops loaded thereon. Loading of the cops onto the upper cylindrical body 32 takes place by the action of the ejector 77 mounted normally to the spool changing assembly, whilst loading of the spools onto the lower cylindrical body 33 is provided by a gripping device 60, composed of a pneumatic piston assembly 61, mounted beside the lower cylindrical body 33, which can move forward, when the lower cylindrical body 33 is facing one of the arms 42, 43 of the carrier 40 carrying the spools to be loaded.

By the forward movement of the pneumatic piston 61 parallel to the empty spools, the end 62 of the gripping device moves over the rear portion of the last spool mounted on one of the arms 43, 44. Mounted pivotally on the end of the pneumatic piston 61 is a bar 63 which is lowered by the action of a further pneumatic device and engages with the back of the last spool. At this point, the piston 61 of the gripping device completes its path of movement and returns with the spools inserting them into the lower cylindrical body 33. The bar 63 is then pivoted and returned to its home position.

The main structure is arranged to serve, as shown in FIG. 1, a plurality of spinning and winding machines, for example, laid as usual in one or two facing banks, such as to form one or more walls.

Thus, the main structure 1 is mounted and set up to stop in front of any of the different winding locations to provide for the spool loading and cop removal. The path wherealong the main structure 1 moves is varied according to the layout of the arrangement of the spinning and winding machinery, but it is important to point out that it is not required to move away from the machines, the removal and delivery operations for the cops and empty spools to and from the storage area being performed by the transport system, the runways of which extend parallel (FIG. 1) to the walls formed by the machines and are arranged such that the main structure 1 can operate with a carrier of the transport system in its proximities whence it can pick up spools and whereto it can deliver cops.

The operating cycle of the main structure in question begins with positioning the main structure itself beside the winding spindle on which the cops are to be replaced. The thread cutting and reattaching assembly is displaced horizontally by the effect of the expansible assembly 26 until it meets the threads along the expansion path towards the cops. The thread is caught within a normally dovetailed projection and drawn to face the blades 31, one of which is fixed and the second of which is actuatable by a pneumatic cylinder 27, forming the cutting device 24. The suction house 30 draws in the severed end of the thread and sucks up the thread produced throughout the duration of the cop replacement operation.

As mentioned, the extruded thread during the cop changing operation is collected in an appropriate reservoir and container.

Advantageously, the action of the pneumatic cylinder 27 is controlled through sensors installed on the expansible assembly 26, either through a revolution counter of the worm rpm, again installed on the expansible assembly 26, which stop and actuate at preset positions, the thread drawing and cutting device.

The spool changing assembly 9 is located beneath the thread cutting and reattaching assembly by means of the worm 37 and the upper cylindrical body 32, is brought to abut against the spool holding spindle 73 by means of the piston 34. In addition, the spindle 73 is braked and released from the winding head 72.

Finally, by the effect of the ejector 77, the cops 74 are ejected from the spool holding spindle and slipped onto the upper cylindrical body 32. At that point, the spool changing assembly is raised by the effect of the electric motor 36 and worm 37 and the lower cylindrical body 33 to preset locations, thanks to the horizontal displacement device driven by the piston 35, whereon the spools are placed at preset locations, is brought into abutment relationship with the pressure spindle 73, which is now empty. The spools 76 are slipped over the spindle by the effect of a sleeve 50 operating on the cylindrical body 33, which pushes out those spools which are slipped over the cylindrical body. They are then locked onto the pressure spindle 73 by known methods, or by compression and related expansion of rubber rings attached to the spindle itself.

The spool changing assembly is then lowered and the column 7, whereon it is mounted, is rotated through 180° to proceed with the operations of loading empty spools and discharging the cops 74.

In this way, the thread cutting and reattaching assembly is allowed to move down to a location below the spool changing assembly for positioning the threads 75 onto the spools 76.

A remarkable aspect of the device forming the subject matter of this invention is that the rotation of the suction hose 30 facilitates re-distribution of the threads, both on the winding head 72 and on the empty spools which are now positioned on the spool holding spindle 73. In fact, with commercially available textile machines, the thread positioning devices and those for insertion of the thread into the traverser (not shown in the figure) are aligned along parallel axes lying, however, on the plane perpendicular to the plane of the threads on the thread guide 71, which plane is of necessity acted upon by the cutting device and on which the suction hose must consequently be located at the time of cutting the threads themselves. Thus, the rotation of the suction hose aligns the retained ends of the threads to said devices without requiring displacement of the entire main structure 1.

It is noteworthy that re-distribution of the threads both on the winding head and on the spools is accomplished by a single extensible movement of the thread cutting and reattaching assembly 6.

In the particular embodiment of the invention, spool and cop handling is accomplished by means of carriers which move along an overhead runway, thus requiring the spool changing assembly to be raised. In the exemplary embodiment shown, each arm 43,44 of the carrier 40 carries one half of the spools and subsequently one half of the cops and it is accordingly necessary that the carrier 40 be moved, but without involving displacement of the main structure 1, to bring its second arm to face the cylindrical bodies of the spool changing assembly. The lower cylindrical body 33 is now empty and is brought to face one of the arms of a suitably positioned carrier; on reaching the correct position of the cylindrical body with respect to the carrier, there occurs the forward movement of the gripping assembly 60 and engagement of the bar 63 with the rear spool slipped over, for example the arm of the carrier 40. The gripping assembly is withdrawn and the first spool set is transferred onto the lower cylindrical body due to vertical movement of the spool changing assembly 9, the cylindrical body 32 whereon the cops are placed, is brought to face the arm 43 of the carrier 40 from which the first spool set has been removed. The ejector device, comprising the sleeve 50 driven by a worm on the interior of the cylindrical body 32, discharges a corresponding set of cops onto the arm 43. Subsequently, the spool changing assembly 9 returns upwards to a position where the lower cylindrical body 33 is in line with arm 44 and the cycle of operations is resumed which, due to the displacement of the carrier 40 the arm 44 is now aligned with said lower cylinder 33. The horizontal displacement feature from the cylindrical bodies 32 and 33, previously illustrated for the operations of aligning with the spool holder 73, may also operate with the operations of alignment with the carrier 40, where the location of the runways on which said carrier operate requires it.

As mentioned in the foregoing, the time required for the entire operation is extremely critical, since it is closely related to the amount of thread lost as waste. A remarkable feature of the invention is that during the effectuation of the spool loading and cop unloading operations, as effected by the spool changing assembly, the thread cutting and reattaching assembly provides in a quite independent manner for the attachment of the threads onto fresh spools, thus enabling production to be resumed.

The shutdown time, therefore, is shorter than that resulting from the sum of the times for the two separate operations, due to the independent operability of the two assemblies making up the main structure 1.

The operations are preferably controlled by microprocessors which ensure high accuracy and reliability of the mechanism, effecting inter alia checks on the positions of the members prior to initiating the following operations, through microswitches and/or photocells.

The apparatus forming the subject matter of the invention brilliantly achieves its objects.

The innovative operating characteristic, based on rotation of the spool changing assembly and suction device of the thread cutting and reattaching assembly, allows, in addition to the cited simultaneousness of the operations, with attendant shortening of the shutdown time, a decreased number of positionings, and in fact a single positioning of the main structure 1, to effect all of the operations, for more reliable operation and faster execution of the cop removal and spool loading.

The use of the apparatus of the invention concurrently with elements which are known in part but improved and made functional as herein described, represents a significant improvement in the pertinent art.

We claim:

1. A doffing and donning apparatus for automatically feeding empty spools and withdrawing cops to and from a textile yarn winding system having a plurality of winding spindles disposed on a support surface, the axis of each of said spindles being perpendicular to said support surface, said apparatus comprising:

(a) a track which is disposed parallel to said support surface;

(b) a main structure supported for horizontal movement on said track, said main structure including a first vertical column which is fixed with respect to said main structure and a second vertical column which is pivotable about a vertical axis;

(c) a single spool changing assembly supported for vertical movement on said second vertical column, said spool changing assembly including two elongated horizontal parallel bodies for doffing completed cops from the spindles and donning empty spools onto the spindles, said spool changing assembly being mounted on a support means which is movable vertically on said second vertical column, said spool changing assembly being pivotable through a rotation of at least 180° about said vertical axis passing through a pivotal connection between said second column and said main structure, said two elongated bodies being aligned in a vertical plane with a vertical distance between them being greater than the radius of a completed cop;

(d) a thread cutting and reattaching assembly supported by said first vertical column and having means for cutting the yarn, sucking continuously the yarn during the doffing and donning operations of said spool changing assembly, and reattaching the yarn on the donned empty spools, said thread cutting and reattaching assembly being supported on a horizontal expansible member, which is extensible in a direction parallel to the axes of said spindles, said horizontal expansible member being supported by service support means disposed on said first vertical column, said service support means being movable vertically along said first vertical column independently of said spool changing assembly; and (e) at least one aerial carrier movably supported on an elevated track for carrying empty spools and cops to and from a storage area to provide said spool changing assembly with empty spools and to take from said spool changing assembly complete cops, said aerial carrier being positionable to transfer spools and cops to and from said horizontal bodies of said spool changing assembly and said aerial carriage including at least one horizontal elongated body for holding cops and empty spools.

2. An apparatus according to claim 1, wherein said thread cutting and reattaching assembly includes a cutting assembly and a thread suction and holding assembly, said suction and holding assembly being movable in a substantially horizontal plane.

3. An apparatus according to claim 2, wherein said thread suction and holding assembly is pivotally connected to said cutting assembly and rotatable in a substantially horizontal plane.

4. An apparatus according to claim 2, wherein said suction and holding assembly includes an air operated suction hose.

5. An apparatus according to claim 4, wherein said suction hose is rotated by a pneumatic cylinder means.

6. An apparatus according to claim 1, wherein said thread cutting and reattaching assembly is positionable to appreciably overlie said spool changing assembly at least during the operations of loading cops onto said elongated bodies and discharging empty spools from said elongated bodies, whereby said doffing and donning operations and the thread cutting and reattaching operations can be performed with a single positioning of said structure in front of a particular winding spindle.

7. An apparatus according to claim 1, wherein said elongated bodies have a suitable cross-section to engage with the inside diameters of said spools.

8. An apparatus according to claim 1, wherein a plurality of aerial carriers are movably supported on said elevated track.

9. An apparatus according to claim 1, wherein said at least one horizontal elongated body of said aerial carrier comprises two horizontal arms which are mounted at one end thereof on said aerial carrier.

10. An apparatus according to claim 1, wherein said spool changing assembly has two working positions, a first position whereat one of said elongated bodies horizontally aligns with a spindle and a second position whereat said elongated bodies are facing in the opposite direction to said first position.

11. An apparatus according to claim 10, wherein at said first position, said elongated bodies substantially underlie said thread cutting and reattaching assembly.

12. An apparatus according to claim 7, wherein said spool changing assembly further comprises means for ejecting the spools from said elongated bodies, said means including an outer sleeve slidable along each of said elongated bodies, said sleeve having a larger diameter than the inside diameter of said spools, each of said elongated bodies having a worm disposed therein which is connected to a respective sleeve, and an electric motor connected to each worm for moving a respective sleeve along a respective elongated body.

13. An apparatus according to claim 1, wherein said spool changing assembly further comprises, a device for gripping empty spools, said gripping device including a hydraulic piston assembly mounted on said spool changing assembly and having a gripping portion pivotally connected at one end thereof to said gripping device for engaging and withdrawing at least one empty spool from said horizontal body of said aerial carrier and transferring the at least one empty spool onto one of said elongated bodies of said spool changing assembly.

* * * * *